US005226305A

United States Patent [19]

Adleman et al.

[11] Patent Number: 5,226,305

[45] Date of Patent: Jul. 13, 1993

[54] ARTICULATED SPLIT ROLLER ASSEMBLY FOR TUBE BENDER

[75] Inventors: Larry G. Adleman; Jeffrey J. Plummer, both of Rockford, Ill.

[73] Assignee: Greenlee Textron Inc., Rockford, Ill.

[21] Appl. No.: 958,952

[22] Filed: Oct. 9, 1992

[51] Int. Cl.[5] ..... B21D 7/00

[52] U.S. Cl. ..... 72/157; 72/159; 72/217; 492/1; 492/40

[58] Field of Search ..... 72/149, 157, 158, 159, 72/364, 387, 465, 459, 413, 481, 217, 215, 216; 29/125, 124, 130, 123, 117

[56] References Cited

U.S. PATENT DOCUMENTS

| | | | |
|---|---|---|---|
| 2,233,292 | 2/1941 | Lewin | 72/459 |
| 3,949,584 | 4/1976 | Pearson et al. | 72/157 |
| 4,025,749 | 5/1977 | Spurr et al. | 29/125 |
| 4,546,632 | 10/1985 | Van Den Kieboom et al. | 29/125 |
| 5,125,252 | 6/1992 | Ayres et al. | 72/157 |
| 5,151,737 | 9/1992 | Johnson et al. | 29/117 |

FOREIGN PATENT DOCUMENTS

| | | | |
|---|---|---|---|
| 1593731 | 9/1990 | U.S.S.R. | 72/157 |

OTHER PUBLICATIONS

Greenlee Product Catalog, Copyright 1990.

*Primary Examiner*—Lowell A. Larson
*Assistant Examiner*—Michael J. McKeon
*Attorney, Agent, or Firm*—Trexler, Bushnell, Giangiorgi & Blackstone, Ltd.

[57] ABSTRACT

Briefly,.and in accordance with the foregoing, the present invention comprises a roller assembly for use with a bending apparatus for bending conduit and the like. The bending apparatus includes a frame, a bending shoe associated with the frame and a drive device for controllably driving the bending shoe. The roller assembly provides a roller which pivotably adjusts to an outside surface of the workpiece to accommodate variations in the workpiece while it is being bent during a rolling operation. The roller assembly includes a shaft attached and supported by the frame, two pivot segments and two roller dies. The pivot segments are positioned along and spaced apart on the shaft and each has an arcuate surface in a facing orientation with the other pivot segment. The roller dies have facing ends and base ends and a pivot socket formed in the base end. The pivot socket is sized and dimensioned for cooperatively mating with the arcuate surface of the pivot segment. A pivot bore extends from the facing ends of each of the roller dies through the die to the pivot socket. The pivot bores may be slightly tapered inwardly from the facing ends towards the pivot socket. Each of the roller dies has a concave rolling surface which is formed for receiving an outside surface of a workpiece placed thereagainst during a bending operation. The cooperative arrangement of the tapered pivot bores and the pivot sockets mated with the pivot segments allows the concave rolling surfaces of the roller dies to pivotably adjust to accommodate dimensional variations in the outside surface of a workpiece during a bending operation.

13 Claims, 5 Drawing Sheets

ARTICULATED SPLIT ROLLER ASSEMBLY FOR TUBE BENDER

BACKGROUND OF THE INVENTION

The present invention pertains to a roller assembly for use with a bending apparatus and a bending apparatus employing a roller assembly of the present invention. More specifically, the roller assembly has split roller dies which are pivotably retained on the roller assembly to accommodate variations in external dimensions a workpiece being bent thereagainst.

A variety of bending apparatus for bending conduits, bars, and the like are available. Many bending apparatus include a bending shoe and a roller assembly. The bending shoe is a partially circular body having several channels of varying diameters formed on the circumference of the shoe. A keeping segment is often provided on one end of each of the channels to retain a piece of conduit in a portion of the channel. The shoe is rotated to wrap a piece of conduit around a selected circumferential channel. The free end of the conduit, the end which is not retained by the keeping segment, moves along a roller assembly which promotes movement of the conduit relative to the bending shoe while the bending shoe is rotating to bend the conduit.

Often, when the bending apparatus has several channels formed around the circumference of the shoe, a corresponding group of rollers will be provided on the roller assembly. For example, a shoe which has two circumferential channels will have two rollers on the corresponding roller assembly. The two rollers will be positioned in a cooperative arrangement so that they promote movement of the free end of the conduit as the conduit is wrapped around the channel on the bending shoe.

Such bending apparatus are used in various industries including construction and plumbing. Metal conduit and pipe are manufactured in various nominal diameters having various wall thicknesses which are generally referred to as aluminum or steel "rigid" conduit and pipe, IMC conduit, or "thin wall" (EMT) conduit. A problem arises when bending large diameter thin wall conduit and pipes, the relatively thin wall of this type of conduit and pipe tends to collapse inwardly or kink and distort during bending. Kinking and distorting occurs when the outer surface of the conduit is not intimately supported during bending.

In order to provide support for variety of conduit diameters, shoes with a variety of bending channel diameters have been provided. The corresponding roller assembly matches and accommodates the diameter of the bending channels on the bending shoe. A problem arises when bending conduit in that the rollers employed in the roller assembly are usually fixed rollers which do not accommodate variations in the conduit which is being bent. A problem arises as the conduit is bent around the shoe such that the free end (the end moving through the roller assembly) tends to become distorted. This problem is exacerbated by large diameter thin wall conduits.

A device as shown in U.S. Pat. No. 4,546,632 issued Oct. 15, 1985, to van den Kieboom et al. shows a roller assembly which has a split roller which allows axial movement of the roller sections along a shaft. The device in van den Kieboom et al. has a problem in that axial movement along a shaft of the roller halves or roller dies does not intimately support the cylindrical outer surface of a workpiece being bent thereagainst. As such, the device as shown in van den Kieboom does not prevent crimping or distortion of the outer surface of the conduit during the bending operation. Further, the device as shown in van den Kieboom requires manual adjustment in order to accommodate different conduit dimensions.

OBJECTS AND SUMMARY OF THE INVENTION

A general object of the present invention is to provide a roller assembly which intimately supports a conduit during a bending operation and which accommodates dimensional variations in the outside surface of the conduit in a continuously variable fashion during the rolling operation.

Another object of the present invention is to provide a roller assembly which accommodates small variations in workpiece dimensions to prevent crimping of the outer surface of the workpiece during a bending operation.

A further object of the present invention is to provide a roller assembly which automatically and continuously adjusts to accommodate variations in the outside dimensions of a workpiece during a bending operation.

Briefly, and in accordance with the foregoing, the present invention comprises a roller assembly for use with a bending apparatus for bending conduit and the like. The bending apparatus includes a frame, a bending shoe associated with the frame and a drive device for controllably driving the bending shoe. The roller assembly provides a roller which pivotably adjusts to an outside surface of the workpiece to accommodate variations in the workpiece while it is being bent during a rolling operation. The roller assembly includes a shaft attached and supported by the frame, two pivot segments and two roller dies. The pivot segments are positioned along and spaced apart on the shaft and each has an arcuate surface in a facing orientation. The roller dies have facing ends and base ends and a pivot socket formed in the base end. The pivot socket is sized and dimensioned for cooperatively mating with the arcuate surface of the pivot segment. A pivot bore extends from the facing ends of each of the roller dies through the die to the pivot socket. Each of the roller dies has a concave facing surface which is formed for receiving an outside surface of a workpiece placed thereagainst during a bending operation. The cooperative arrangement of the tapered pivot bores and the pivot sockets mated with the pivot segments allows the concave facing surfaces of the roller dies to pivotably adjust to accommodate variations in the outside surface of a workpiece during a bending operation.

BRIEF DESCRIPTION OF THE DRAWINGS

The organization and manner of the structure and operation of the invention, together with further objects and advantages thereof, may be understood by reference to the following description taken in connection with the accompanying drawings, wherein like reference numerals identify like elements, and in which.

DETAILED DESCRIPTION OF THE ILLUSTRATED EMBODIMENT

Figure 1:
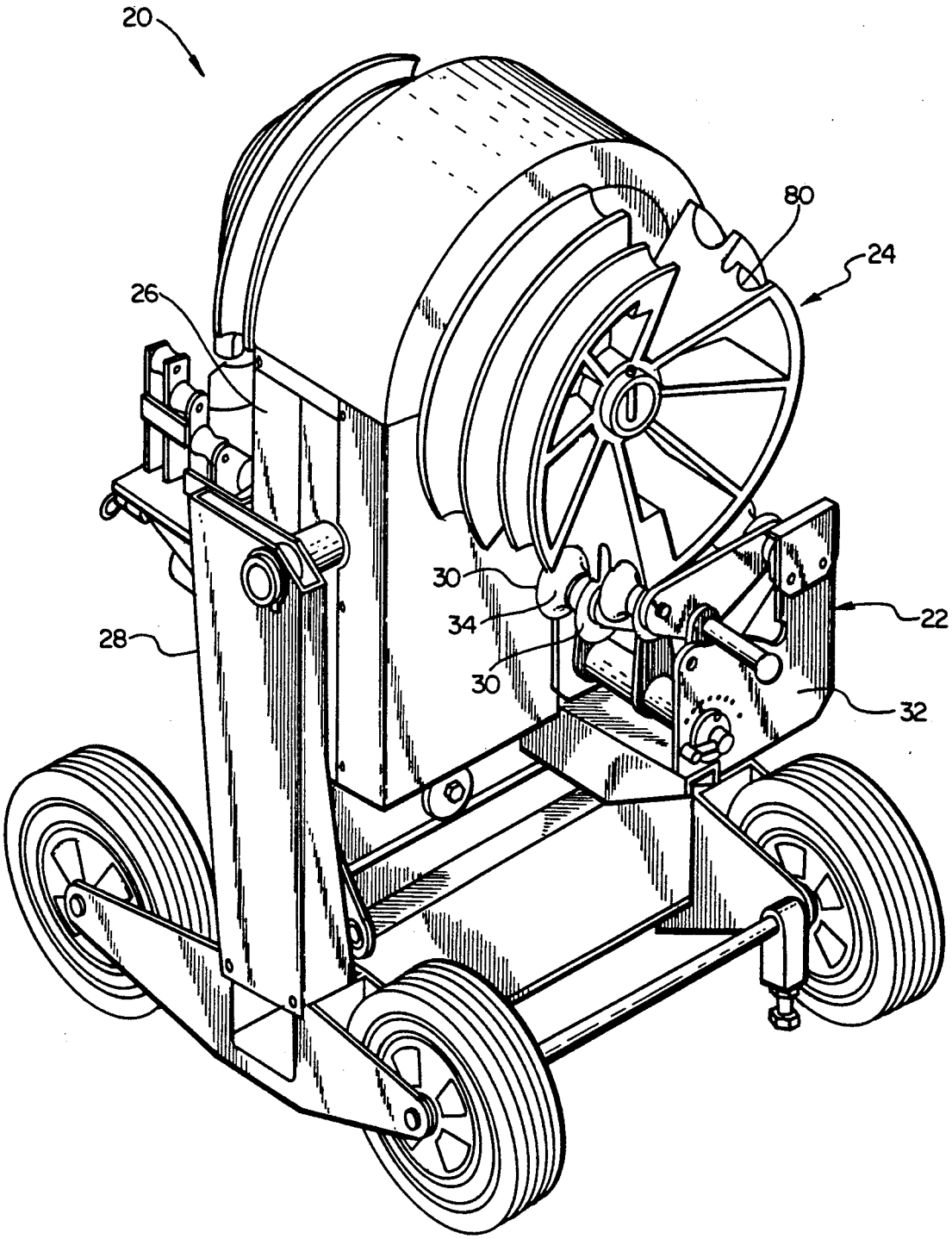
FIG. 1 is a perspective view of a bending apparatus showing a bending shoe in a cooperative relationship with a roller assembly of the present invention.

While the invention may be susceptible to embodiment in different forms, there is shown in the drawings, and herein will be described in detail, two embodiments of the present invention with the understanding that the present disclosure is to be considered an exemplification of the principles of the invention and is not intended to limit the invention to that as illustrated and described herein.

Referring now to the drawings, wherein like parts are designated by the same reference numerals throughout the figures, a bending apparatus 20 including a roller assembly 22 in accordance with the present invention is shown in FIG. 1. The bending apparatus 20 includes a bending shoe 24 mounted in a cooperative relationship relative to the roller assembly 22 and includes means 26 for driving the bending shoe 24. The bending shoe 24 and the roller assembly 20 are attached to a support structure 28 which allows the bending apparatus 20 to be freely moved about.

Figure 2:
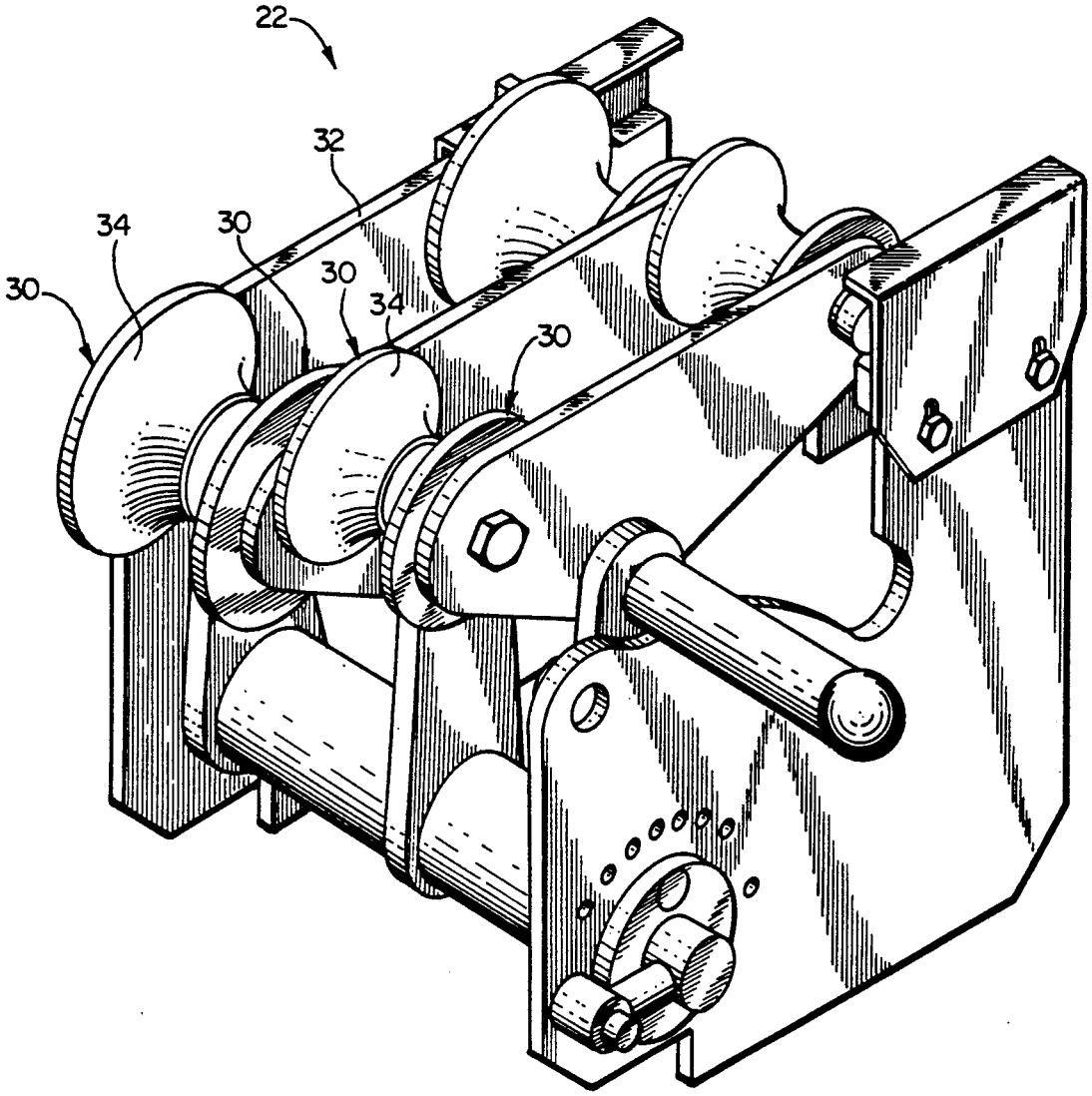
FIG. 2 is an enlarged perspective view of the roller assembly as shown in FIG. 1 showing a pair of pivotable roller dies attached to a frame.

With reference to FIG. 2, the roller assembly 22 includes multiple roller dies 30 which are movably attached to a frame 32. The roller dies 30 are positioned in pairs on the frame with concave facing rolling surfaces 34 of each roller die 30 in a facing orientation. The facing rolling surfaces 34 cooperatively support a workpiece passing therebetween.

Figure 4:
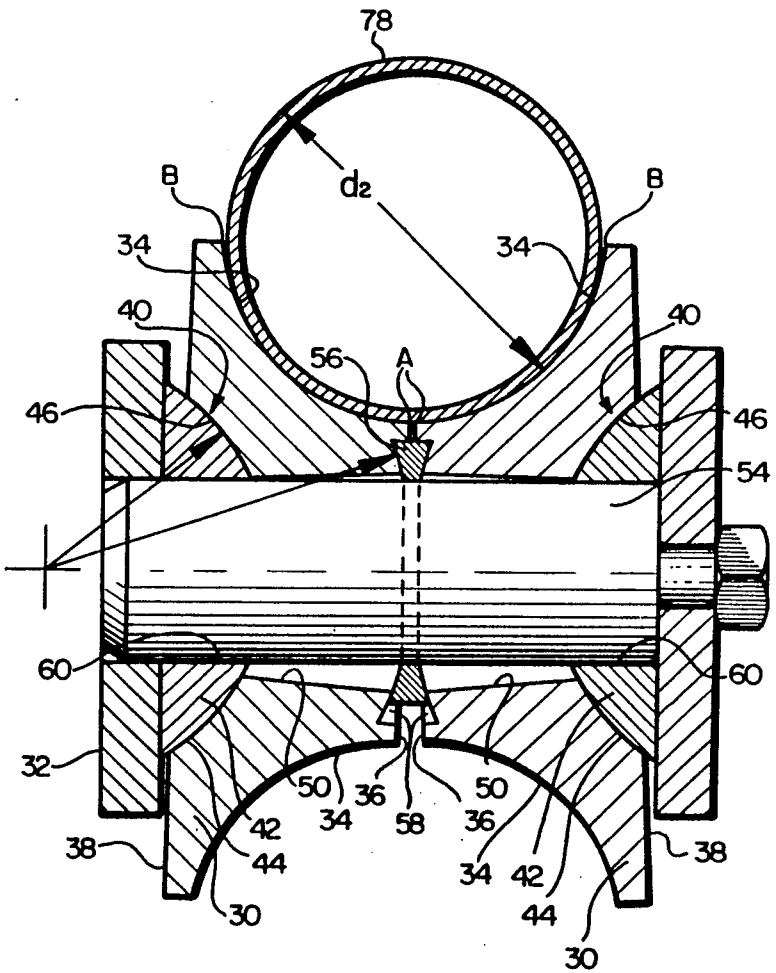
FIG. 4 is a partial fragmentary cross-sectional view of a pair of roller dies in which the dies are pivoted slightly downwardly in order to accommodate a workpiece which has a smaller diameter than the workpiece as shown in FIG. 3.
Figure 3:
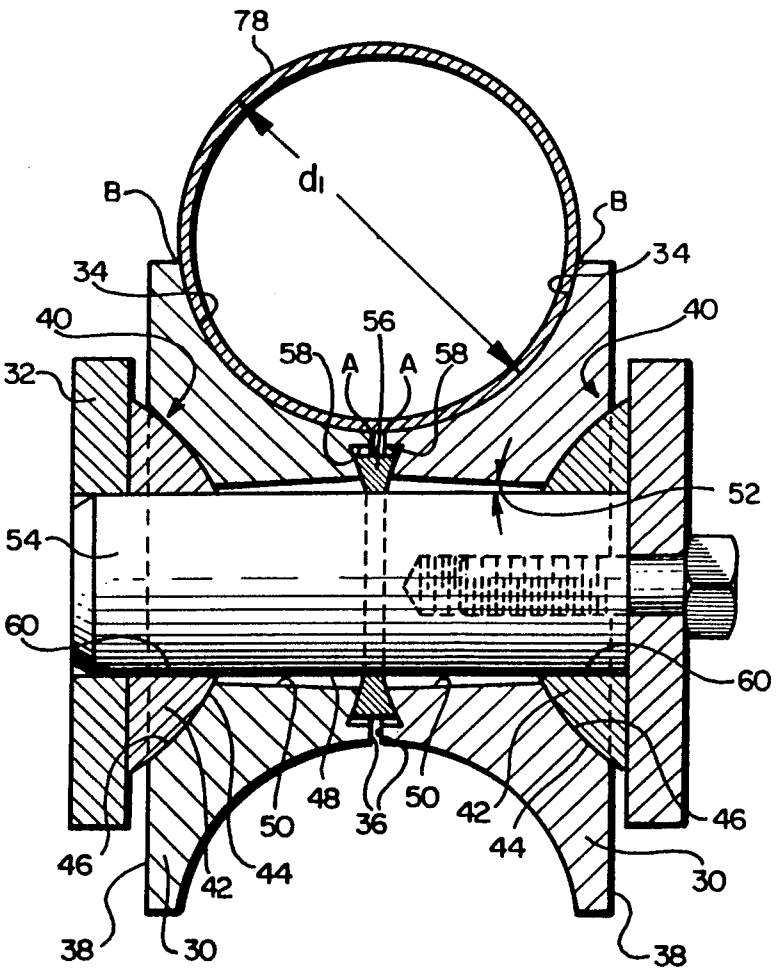
FIG. 3 is a partial fragmentary cross-sectional view of a pair of roller dies having oppositely positioned, concave facing surfaces with a workpiece cooperatively positioned therebetween.

Turning to FIGS. 3 and 4, each roller die 30 has a facing end 36 and a base end 38 distal the facing end 36. Each roller die 30 is associated with means 40 for pivoting the roller die 30 or pivoting means 40. As shown in FIGS. 3 and 4, the pivoting means 40 includes a pivot segment 42 having a partially spherical or arcuate surface 44 formed on the outer portion thereof. Pivot means 40 also includes a pivot socket 46 which is formed in the base end 38 of each roller die 30, the pivot socket 46 being partially spherical and of a mating shape with respect to the surface 44.

A pivot bore 48 is formed extending from the facing end 36 through the roller die 30 to the pivot socket 46. An inside surface 50 of the pivot bore 48 may be slightly inwardly tapered from the facing end 36 towards the pivot socket 46. The taper on the inside surface 50 of the pivot bore 48 defines a taper angle 52 of approximately 0°-10°.

As shown in FIGS. 2, 3, and 4, the roller dies 30 are rotatably retained on the frame 32 by a shaft 54 which extends through the pivot bore 48. As shown in FIG. 3, each pair of roller dies 30 is assembled with a pivot segment 42 positioned in abutment with the frame 32 having the shaft 54 extending therethrough. The arcuate surface 44 of the pivot segment 42 mates in the pivot socket 46 of the corresponding roller die 30. The relationship of the roller dies 30 to the corresponding pivot segments 42 and the relationship of the taper angle 52 in the pivot bore 48 allow the roller dies 30 to pivot about the pivot segments 42. Pivotal movement of the roller dies 30 about the pivot segments 42 adjusts the inside dimensions of the rolling surfaces 34 of the roller dies 30 which are in facing orientation.

Pivotal movement is controlled by a spacer washer 56 which is positioned in a washer groove 58 formed in each of the facing ends 36 of each of the roller dies 30. Limitation on the pivoting and axial movement of the roller dies 30 relative to each other about the pivot segment 42 prevents the facing ends 36 of the roller dies 30 from contacting each other in a detrimentally binding manner.

Figure 5:
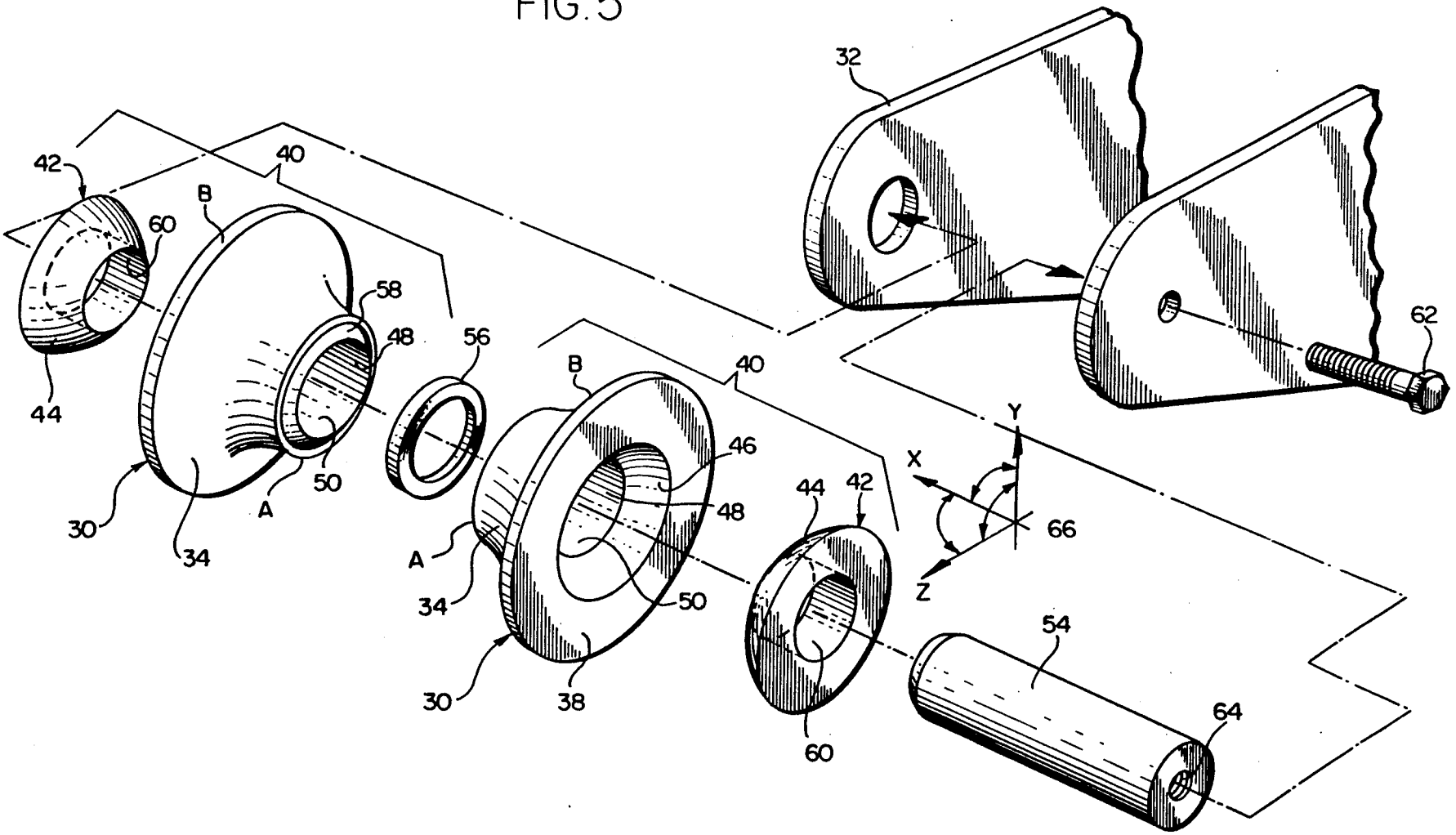
FIG. 5 is an exploded view of the roller assembly as shown in FIGS. 3 and 4 showing the relationship between the roller dies, pivot segments, a limiting washer, a shaft, and the frame.

FIG. 5 provides an exploded view of the assembly as shown in FIGS. 3 and 4. As shown in FIG. 5, the pivot segments 42 are independent pieces which include a shaft bore 60 for receiving the shaft 54 therethrough. As shown, the shaft 54 inserts through the shaft receiving bore 60 of a pivot segment 42, through a corresponding pivot socket 46 and through the pivot bore 48 of the roller die 30. The washer 56 fits over the shaft 54 and mates in the corresponding washer grooves 58, 58 of each of the roller dies 30. The shaft 54 then continues through the pivot bore 48 of the second roller die 30 through the corresponding pivot socket 46 (not shown in FIG. 5) and through the shaft bore 60 of the second pivot segment 42. A fastener 62 is driven into a fastener receiving hole 64 in the shaft to retain the assembled roller dies 30, pivot segments 42, and washer 56 on the frame 32.

The embodiment of the present invention as shown in FIGS. 3, 4, and 5 allows pivotal movement of the roller dies 30 in any of three orthogonal directions (indicated for reference purposes by reference numeral 66 and the x, y, z directional arrows as shown in the perspective of FIG. 5). As such, the roller dies 30 may pivot between the x and z direction, between the x and y direction, and may roll in the y and z direction. Additionally, it should be clear that complex pivotal movement is possible due to the partially spherical or arcuate surface 44 of the pivot segments 42.

Figure 6:
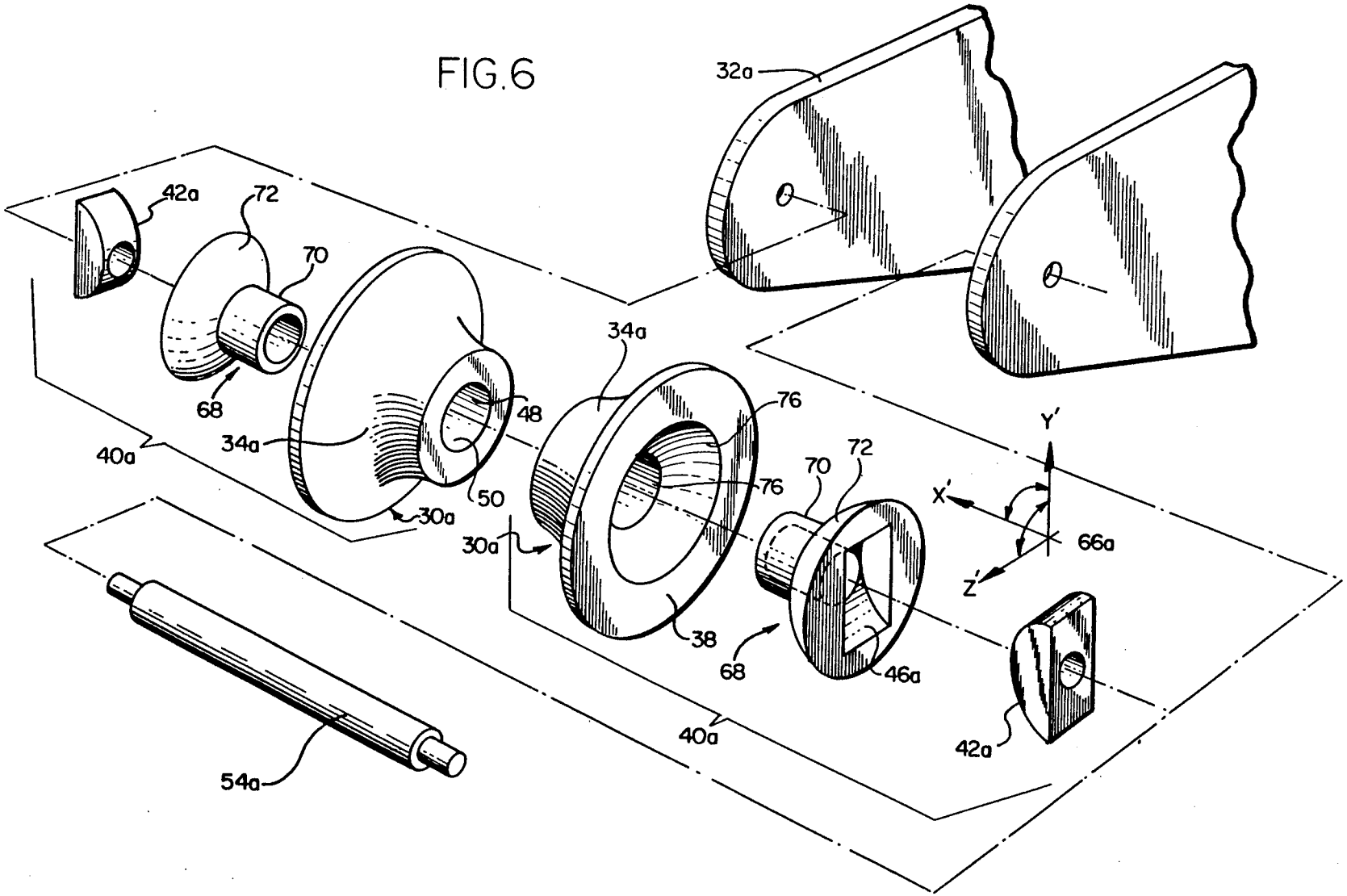
FIG. 6 shows an alternate embodiment of the present invention in which the pivot segments limit the direction of pivoting of the roller assemblies during a rolling operation.

Turning now to an alternate embodiment of the present invention as shown in FIG. 6, identical or equivalent elements that have been described hereinabove will be referred to by the same reference numeral accompanied by an alphabetic suffix such as "a".

As shown in FIG. 6, the roller dies **30*a* have rolling surfaces 34*a* which are in facing orientations. The means 40*a* for pivoting the roller dies 30*a* include a pivot segment 42*a* and a rotary segment 68. The rotary segment 68 includes a shank 70 and a frustoconical or partially spherical shaped surface 72. A pivot socket 46*a* is formed in an end of the rotary segment 68 opposite the shank 70. The pivot segment 42*a* cooperatively engages the pivot socket 46*a* allowing pivotal movement of the roller die 30*a***.

With reference to the orthogonal coordinates (as indicated by reference numeral **66*a*) the arrangement of the means 40*a* for pivoting the roller dies 30*a* allow pivotable movement of the roller dies 30*a* between the x′ and the y′ directions. The roller die 30*a* is rotatable in the y′ and z′ directions due to the cooperative engagement of the frustoconical or partially spherical shaped surface 72 in a cooperatively formed rotary socket 76 formed in the roller die 30***a*. The arrangement as shown in FIG. 6 prevents pivotal movement in the x' and z' directions, whereas, the embodiment as shown in FIG. 5 allows for pivotal movement in the x and z directions.

In use, the roller assembly 22 is cooperatively positioned relative to a bending shoe 24. When the bending apparatus 20 is operated, a workpiece 78 such as a conduit or a pipe is retained on the bending shoe 24 in a selected one of the channels 80 formed on the circumference of the bending shoe 24 and rests against the roller dies 30 of the roller assembly 22. Since the roller assembly 22 includes two cooperatively positioned roller dies 30 operatively associated with means 40 for pivoting the roller dies 30, the roller assembly 22 can adapt to variations in the outside dimensions of the workpiece 78 which passes between the rolling surfaces 34 of the roller dies 30. In other words, the corresponding supporting face formed by the rolling surfaces 34 of the roller dies 30 automatically adjust and change to accommodate the outside surface of the workpiece.

With reference to FIGS. 3 and 4, during a bending operation, the workpiece 78 is forced towards the shaft 54 of the roller assembly 22 such that the workpiece 78 will contact the roller dies 30 at point A as shown in FIGS. 3 and 4. Force is applied at point A,A on the roller dies 30 and creates a torque reaction causing the roller dies 30 to pivot about the pivot means 40 until the rolling surfaces 34 contact the workpiece at point B as shown in FIGS. 3 and 4. The workpiece 78 shown in FIG. 3 has an outside diameter of $d_1$. Continuous variations in the outside surface of the workpiece 78 will cause varying degrees of pivoting, but the workpiece 78 will be continuously supported at points A and B within a predetermined range of pivotal movement.

With reference to FIG. 4, the outside diameter $d_2$ is smaller than the diameter as shown in FIG. 3 of $d_1$. The smaller diameter $d_2$ of the workpiece 78 as shown in FIG. 4 causes the roller dies 30 to pivot about the pivotal means 40 such that points A—A and B—B are brought closer to each other. As shown in the upper portion of FIG. 4, the washer 56 positioned in the groove 58 prevents points A—A of the facing surfaces 36 from contacting each other. As shown in both FIGS. 3 and 4, the pivotable capabilities of the roller dies 30 allow the rolling surfaces 34 to continuously intimately contact the outside surface of the workpiece 78 over a range of dimensions.

In use, with regard to the embodiment as shown in FIG. 6, the roller assembly 22*a* is positioned relative to a bending shoe 24. When the bending apparatus 20 is operated, a workpiece 78, such as a conduit or a pipe, is retained on the bending shoe 24 in a selected one of the channels 80 formed on the circumference of the bending shoe 24 and rests against the roller dies 30*a* of the roller assembly 22*a*. Since the roller assembly 22*a* includes two cooperatively positioned roller dies 30*a* operatively associated with means 40*a* for pivoting the roller dies 30*a*, the roller assembly 22*a* can adapt to variations in the outside dimensions of the workpiece 78 which passes between the rolling surfaces 34*a* of the roller dies 30*a*. In other words, the corresponding supporting face formed by the rolling surfaces 34*a* of the roller dies 30*a* automatically adjust and change to accommodate the outside surface of the workpiece.

The means 40*a* for pivoting as shown in FIG. 6 is limited to pivoting between the x' and y' axes in rotation between the y' and z' axes. As such, in use, when a workpiece is positioned against the rolling surfaces 34*a* of the roller dies 30*a*, the driving movement of the bending apparatus tends to rotate the roller dies 30*a* around the x' axis. Rotary movement of the roller die 30*a* around the x' axis is limited by the frustoconical or partially spherical shaped surface 72 engaged with the rotary socket 76 and the shank 70 in the pivot bore 48. An additional degree of movement occurs between the mating surfaces of the pivot segment 42*a* engaged with the pivot socket 46*a*. In use, the engagement between the pivot segment 42*a* and the pivot socket 46*a* provides movement between the x' and y' axes.

While preferred embodiments of the present invention are shown and described, it is envisioned that those skilled in the art may devise various modifications of the present invention without departing from the spirit and scope of the appended claims. The invention is not intended to be limited by the foregoing disclosure.

The Invention claimed is:

1. A roller assembly for use with a bending apparatus for bending conduit and the like, said bending apparatus including a frame, a bending shoe and means for controllably driving one of said bending shoe and said roller assembly;

said roller assembly comprising:

a pair of roller dies adapted to be operatively associated with a frame of a bending apparatus in a cooperative relationship with a bending shoe, said roller dies having facing rolling surfaces cooperatively shaped for supporting a workpiece passing over said rolling surfaces; and means for pivoting at least one of said roller dies, said means for pivoting being positioned between a corresponding one of said roller dies and said frame for pivotably adjusting said rolling surface of said roller die relative to a surface of a workpiece to accommodate variations in the surface of the workpiece.

2. A roller assembly as recited in claim 1, said means for pivoting comprising:

an arcuate pivot segment operatively associated with each of said roller dies and a corresponding portion of said frame; and a pivot socket disposed on each of said roller dies, said pivot socket being shaped and positioned for cooperatively mating with a corresponding one of said pivot segments.

3. A roller assembly as recited in claim 1, further comprising:

a shaft operatively associated with said frame of said rolling assembly;

said means for pivoting being operatively associated with said shaft;

a partially spherical pivot segment of said means for pivoting operatively associated with each of said roller dies and a corresponding portion of said frame; and a pivot socket of said means for pivoting formed in each of said roller dies, said pivot socket beig shaped and positioned on each of said roller dies for cooperatively mating with a corresponding one of said pivot segments.

4. A roller assembly as recited in claim 3, further comprising:

facing ends of each of said roller dies having a pivot bore extending therethrough, each of said pivot bores extending through a corresponding pivot socket;

each of said pivot segments being operatively associated with said shaft and engaging a corresponding pivot socket;

said shaft extending between said pivot segments spaced apart and positioned thereon, said shaft extending through both of said pivot sockets and both of said pivot bores.

5. A roller assembly as recited in claim 4, wherein each of said pivot bores tapers inwardly from said facing surface towards said pivot socket, said pivot bores having a taper angle of from 0° to 10°.

6. A roller assembly for use with a bending apparatus for bending conduit and the like; said bending apparatus including a frame, a bending shoe operatively associated with said frame and drive means for controllably driving one of said bending shoe and said roller assembly; said roller assembly pivotably adjusting to a surface of a workpiece to accommodate dimensional variations in said workpiece; said roller assembly comprising:

a shaft positioned between two portions of said frame;

two pivot segments positioned on and spaced apart along said shaft;

an arcuate surface formed on a surface of each of said pivot segments, said arcuate surfaces being positioned in a facing orientation;

two roller dies, each of said roller dies having a facing end and a base end;

a pivot socket operatively associated with said base end of each of said roller dies for cooperatively mating with said pivot segment;

a pivot bore extending through said facing end of each of said roller dies and into said pivot socket;

said shaft extending from said arcuate surfaces of said pivot segments and through both of said pivot sockets and pivot bores;

said roller dies being positioned in a cooperative relationship with said bending shoe; and facing rolling surfaces of said roller dies cooperatively shaped for supporting a workpiece passing between said rolling surfaces and said bending shoe.

7. A roller assembly as recited in claim 6, wherein each of said pivot bores tapers inwardly from said facing ends towards said pivot socket, said pivot bores having a taper angle of from 0° to 10°.

8. A a workpiece bending apparatus for bending conduits, bars, and the like, said bending apparatus comprising:

a frame;

a bending shoe assembly operatively associated with said frame;

a roller assembly operatively associated with said frame for cooperatively supporting a workpiece passing between said roller assembly and said bending shoe;

a shaft of said roller assembly operatively attached to said frame;

a pair of roller dies of said roller assembly adapted to be operatively associated with said frame of said bending apparatus in a cooperative relationship with said bending shoe, said roller dies having facing rolling surfaces cooperatively shaped for supporting a workpiece passing over said rolling surfaces;

means for pivoting at least one of said roller dies of said roller assembly, said means for pivoting being positioned between a corresponding one of said roller dies and said frame for pivotably adjusting said rolling surface of said roller die relative to a surface of a workpiece to accommodate variations in the surface of the workpiece; and means for driving operatively associated with said bending shoe or said roller assembly for providing relative motion between said bending shoe and said roller assembly to bend a workpiece positioned therebetween.

9. A workpiece bending apparatus as recited in claim 8, said means for pivoting comprising:

an arcuate pivot segment operatively associated with each of said roller dies and a corresponding portion of said frame; and a pivot socket disposed on each of said roller dies, said pivot socket being shaped and positioned for cooperatively mating with a corresponding one of said pivot segments.

10. A workpiece bending apparatus as recited in claim 8, further comprising:

a shaft operatively associated with said frame of said rolling assembly;

said means for pivoting being operatively associated with said shaft;

a partially spherical pivot segment of said means for pivoting operatively associated with each of said roller dies and a corresponding portion of said frame; and a pivot socket of said means for pivoting formed in each of said roller dies, said pivot socket being shaped and positioned on each of said roller dies for cooperatively mating with a corresponding one of said pivot segments.

11. A workpiece bending apparatus as recited in claim 10, further comprising:

facing ends of each of said roller dies having a pivot bore extending therethrough, each of said pivot bores extending through a corresponding pivot socket;

each of said pivot segments being operatively associated with said shaft and engaging a corresponding pivot socket;

said shaft extending between said pivot segments spaced apart and positioned thereon, said shaft extending through both of said pivot sockets and both of said pivot bores.

12. A workpiece bending apparatus as recited in claim 11, wherein each of said pivot bores taper inwardly from said facing surface towards said pivot socket, said pivot bores having a taper angle of from 0° to 10°.

13. A workpiece bending apparatus for bending conduits, bars, and the like, said bending apparatus comprising:

a frame;

a bending shoe assembly operatively associated with said frame;

a roller assembly operatively associated with said frame for cooperatively supporting a workpiece passing between said roller assembly and said bending shoe;

a shaft of said roller assembly operatively attached to said frame;

two pivot segments associated with and spaced apart along said shaft, each of said pivot segments having an arcuate surface in a facing orientation with the other pivot segment;

two roller dies, each of said roller dies having a facing end and a base end, a pivot socket operatively associated with said base end for cooperatively mating with said arcuate surface of said pivot segment, said facing ends having a pivot bore extending therethrough to said pivot socket, said shaft extending from said arcuate surfaces of said pivot segments and through both of said pivot sockets and pivot bores;

said roller dies being positioned in a cooperative relationship with said bending shoe; facing rolling surfaces of said roller dies cooperatively shaped for supporting a workpiece passing between said rolling surfaces and said bending shoe; and means for driving operatively associated with said bending shoe or said roller assembly for providing relative motion between said bending shoe and said roller assembly to bend a workpiece positioned therebetween.

* * * * *